US006029618A

United States Patent [19]

Hara et al.

[11] Patent Number: 6,029,618

[45] Date of Patent: Feb. 29, 2000

[54] VARIABLE VALVE ACTUATION APPARATUS

[75] Inventors: Seinosuke Hara; Makoto Nakamura; Shinichi Takemura, all of Kanagawa, Japan

[73] Assignees: Nissan Motor Co., Ltd., Yokohama; Unisia Jecs Corporation, Atsugi, both of Japan

[21] Appl. No.: 09/179,420

[22] Filed: Oct. 27, 1998

[30] Foreign Application Priority Data

Nov. 7, 1997 [JP] Japan ..... 9-305120

[51] Int. Cl.[7] ..... F01L 13/00

[52] U.S. Cl. ..... 123/90.16; 123/90.33; 123/90.17

[58] Field of Search ..... 123/90.15, 90.16, 123/90.17, 90.2, 90.22, 90.27, 90.33, 90.34, 90.6

[56] References Cited

U.S. PATENT DOCUMENTS

| | | | |
|---|---|---|---|
| 4,397,270 | 8/1983 | Aoyama | 123/90.16 |
| 4,572,118 | 2/1986 | Baguena | 123/90.16 |
| 5,148,783 | 9/1992 | Shinkai et al. | 123/90.16 |
| 5,431,132 | 7/1995 | Kreuter et al. | 123/90.16 |
| 5,586,527 | 12/1996 | Kreuter | 123/90.15 |
| 5,592,906 | 1/1997 | Kreuter et al. | 123/90.16 |
| 5,732,669 | 3/1998 | Fischer et al. | 123/90.16 |
| 5,787,849 | 8/1998 | Mitchell | 123/90.17 |
| 5,899,180 | 5/1999 | Fischer | 123/90.16 |

*Primary Examiner*—Weilun Lo
*Attorney, Agent, or Firm*—Foley & Lardner

[57] ABSTRACT

A variable valve actuation (VVA) apparatus is disclosed. The VVA apparatus can keep an engine cylinder valve closed. Rotating a camshaft in timed relation with a crankshaft of the engine causes an eccentric crank cam to move a link or crank arm, thereby causing one end of a rocker arm to reciprocate. This causes the other end of the rocker arm to reciprocate. The reciprocating motion of the other end of the rocker arm is transmitted via a link to a valve operating (VO) cam, thereby causing the VO cam to pivot to push a valve lifter for opening the associated cylinder valve. An eccentric circular cam, fixed to a control rod, supports the rocker arm for rotation relative thereto in such a manner that rotation of the control rod causes a pivot center of the rocker arm to move, thereby changing position of the VO cam relative to the valve lifter. The change in the position of the VO cam causes its valve lift diagram to change. The VO cam has a base circle portion that extends over a predetermined angle with respect to the center of pivot of the VO cam and the contiguous ramp portion. A predetermined valve clearance exists between the VO cam and the valve lifter when the base circle portion faces the valve lifter. When it is desired to keep the associated cylinder valve closed, the control rod is rotated to establish a state wherein the VO cam pivots to bring not only base circle but also the ramp portions into facing relation with the valve lifter. In this state, the maximum cam lift of a cam lift diagram is greater than zero and less than the valve clearance.

16 Claims, 11 Drawing Sheets

VARIABLE VALVE ACTUATION APPARATUS

FIELD OF THE INVENTION

The present invention relates to a variable valve actuation (VVA) apparatus in an internal combustion engine having cylinder valves.

BACKGROUND OF THE INVENTION

U.S. Pat. No. 4,397,270 (=JP-A 55-137305) discloses a variable valve timing and lift system. It includes a driving shaft, a control rod with axially spaced eccentric cams, and a pivot structure. The pivot structure supports valve operating (VO) cams for pivotal motion above valve lifters of cylinder valves. Springs are mounted for the VO cams, respectively. Each of the springs biases one of the corresponding rocker cams toward its rest position where the associated cylinder valve closes. Rocker arms operate the VO cams, respectively. The eccentric cams, which are in rotary unison with the control rod, bear the rocker arms, respectively. An axis of each of the eccentric cams serves as the center of drive of the corresponding one of the rocker arms. Cams fixed to the driving shaft operate the rocker arms, respectively. An electronic control module (ECM) or a controller is provided. Sensors on the engine send information on engine speed, engine load, vehicle speed, and coolant temperature to the ECM. At a predetermined switchover point, the ECM sends a signal to an actuator for the control rod. As the actuator turns the control rod, the eccentricity of each of the eccentric cams with respect to an axis of the control rod changes. This alters the position of pivot axis of the rocker arms relative to the position of pivot axis of the VO cams. This causes variation in valve timing and lift of each of the cylinder valves.

It would be desired to keep the cylinder valves closed when so required during some engine operation mode. An object of the present invention is to provide a VVA apparatus that can keep the associated cylinder valve or valves closed. Specifically, the present invention aims at providing a VVA apparatus that can keep the associated cylinder valve or valves closed and that can be installed within a limited space above the engine cylinder head.

SUMMARY OF THE INVENTION

According to the present invention, there is provided a variable valve actuation (VVA) apparatus in an internal combustion engine having cylinder valves, comprising:

a cylinder valve having a valve closed position;

a valve lifter;

a valve operating (VO) cam arranged for pivotal motion about a first predetermined axis for operating said cylinder valve via said valve lifter;

a crank cam arranged for rotation about a second predetermined axis;

a motion transmitting mechanism operatively interconnecting said crank cam and said VO cam, said motion transmitting mechanism having a maximum cam lift position wherein said pivotal motion of VO cam is restrained within a first extension and a minimum cam lift position wherein said pivotal motion is restrained within a second extension;

said VO cam having a base circle portion, said VO cam and said valve lifter defining therebetween a valve clearance when said base circle portion assumes a predetermined relation relative to said cylinder valve;

wherein, when said motion transmitting mechanism is in said minimum lift position, the VO cam provides variable cam lift values during said pivotal motion thereof, said variable cam lift values having the maximum cam lift that is greater than zero and less than said valve clearance.

DESCRIPTION OF THE PREFERRED EMBODIMENT

Figure 1:
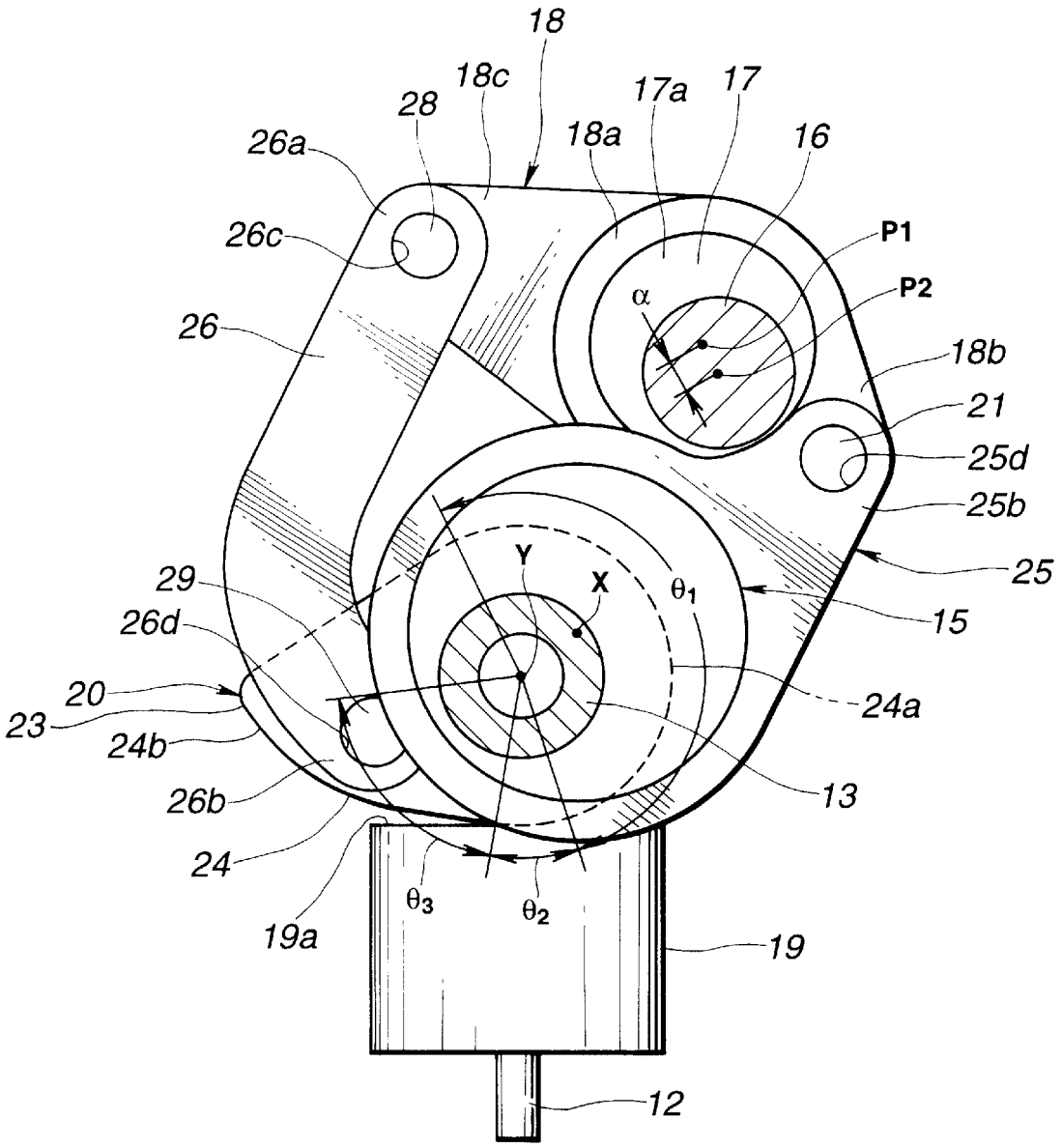
FIG. 1 is a cross sectional view of a VVA apparatus taken through the line 1—1 in FIG. 2.

Referring to the accompanying drawings, like reference numerals and characters are used throughout all of the Figures to denote like or similar parts or portions for the sake of simplicity of description.

Figure 2:
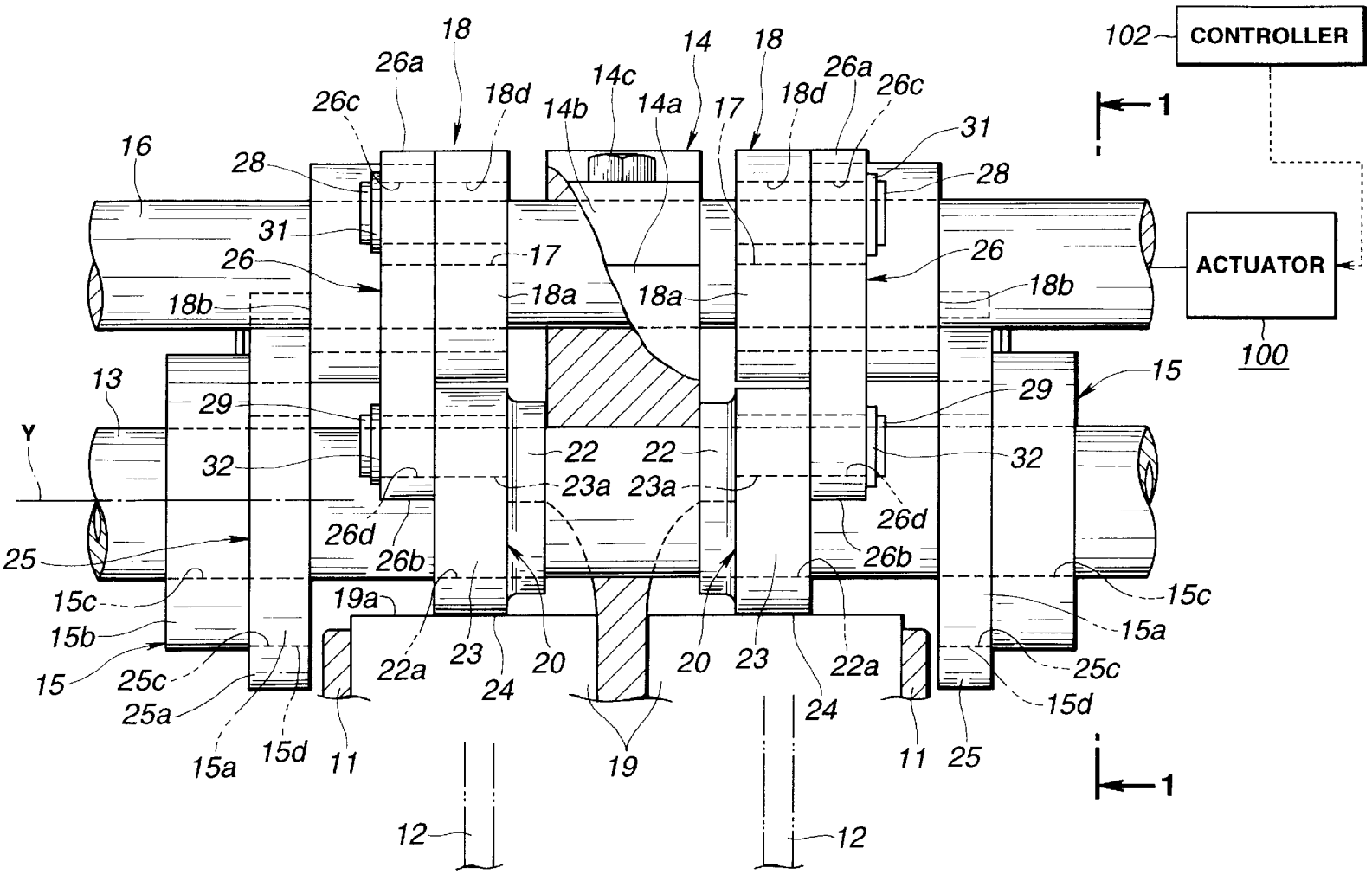
FIG. 2 is a fragmentary sectioned side view of an upper portion of a cylinder head with the VVA apparatus.

Referring to FIG. 2, the reference numeral 11 designates a cylinder head of an overhead camshaft internal combustion engine. The engine has four cylinder valves per cylinder. They include two intake valves 12, 12 and two exhaust valves (not shown). Valve guides, not shown, of the cylinder head 11 support the intake valves 12, 12, respectively.

A variable valve actuation (VVA) apparatus implementing the present invention includes at least one cylinder valve that opens when a cylinder performs an intake phase or an exhaust phase. The apparatus is described hereinafter in detail taking the intake valves 12, 12 as an example of the cylinder valves. It is to be noted that the cylinder valve may take the form of an exhaust valve if desired.

Figure 4:
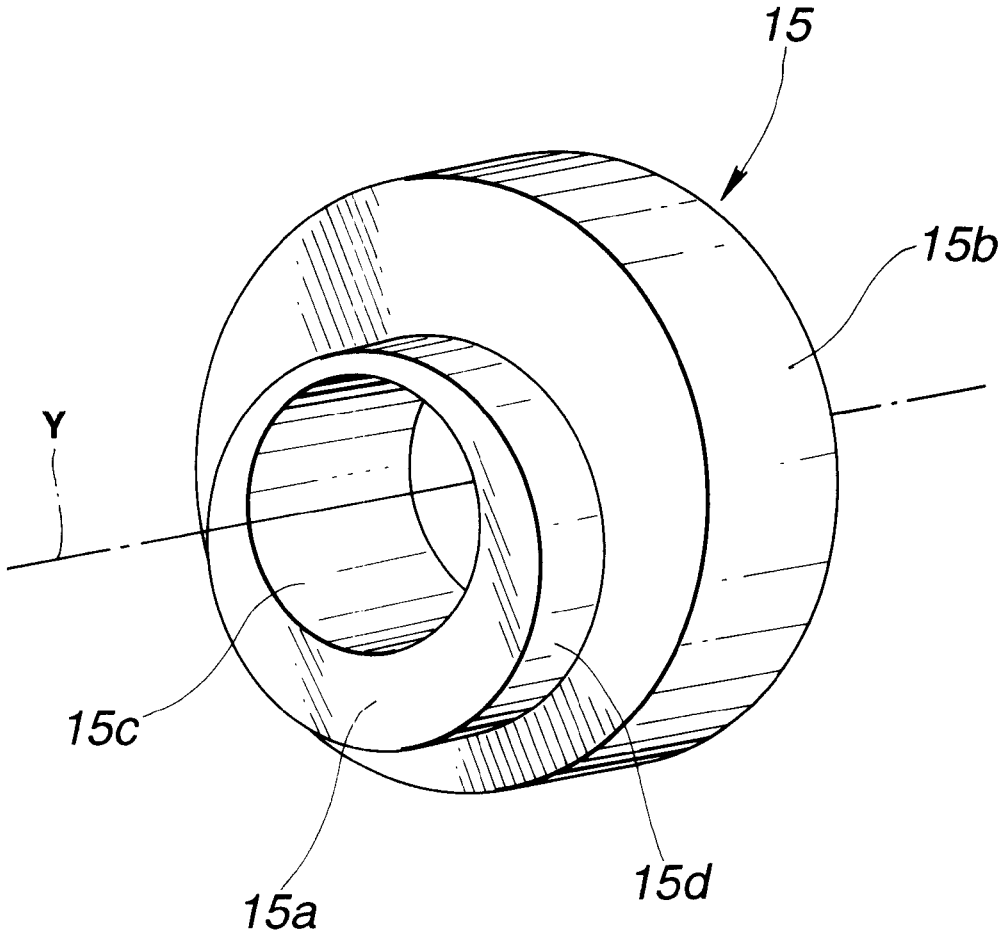
FIG. 4 is a perspective view of a crank cam of the VVA apparatus.

Cam bearings, only one being shown at 14, on the cylinder head 11 support a driving shaft 13, which is hollowed, and a control rod 16. Viewing in FIG. 2, the driving shaft 13 is disposed above and in operative association with valve lifters 19, 19 for the intake valves 12, 12. The cam bearing 14 includes a main bracket 14*a* that holds the driving shaft 13 on the cylinder head 11. A subordinate bracket 14*b* holds the control rod 16 on the main bracket 14*a* in spaced relationship with the driving shaft 13. A pair of fasteners in the form of bolts 14*c* (see FIG. 1) fixedly secures the brackets 14*a* and 14*b* to the cylinder head 11. A crankshaft (not shown) provides drive force from the engine to the driving shaft 13 via pulleys and a timing chain. The driving shaft 13 extends from a front end of the cylinder head 11 to a rear end thereof The driving shaft 13 has two axially spaced crank cams, in the form of eccentric rotary (ER) cams 15, 15, per cylinder. The crank cams 15, 15 are fixed to the driving shaft 13. As best seen in FIG. 2, two crank cams 15, 15 are provided for the two intake valves 12, 12, respectively. They are axially spaced from each other and out of interference with valve lifters 19, 19 for the intake valves 12, 12. Referring also to FIG. 4, each crank cam 15 has a circular cam section 15*a* and a circular flange section 15*b*, and is formed with a through hole 15*c*. The driving shaft 13 is press fitted into the through holes 15*c* of the crank cams 15. The circular cam section 15*a* of each crank cam 15 has a cylindrical outer peripheral surface 15*d* and an axis or center X (see FIG. 1) that is offset from an axis Y, namely a shaft axis, of rotation of the driving shaft 13. In this embodiment, the crank cams 15, 15 for each cylinder have centers X offset in the same eccentric direction and amount from the axis Y of the driving shaft 13. However, they may have different eccentric directions and/or amounts with respect to the shaft axis Y, if desired.

Figure 3:
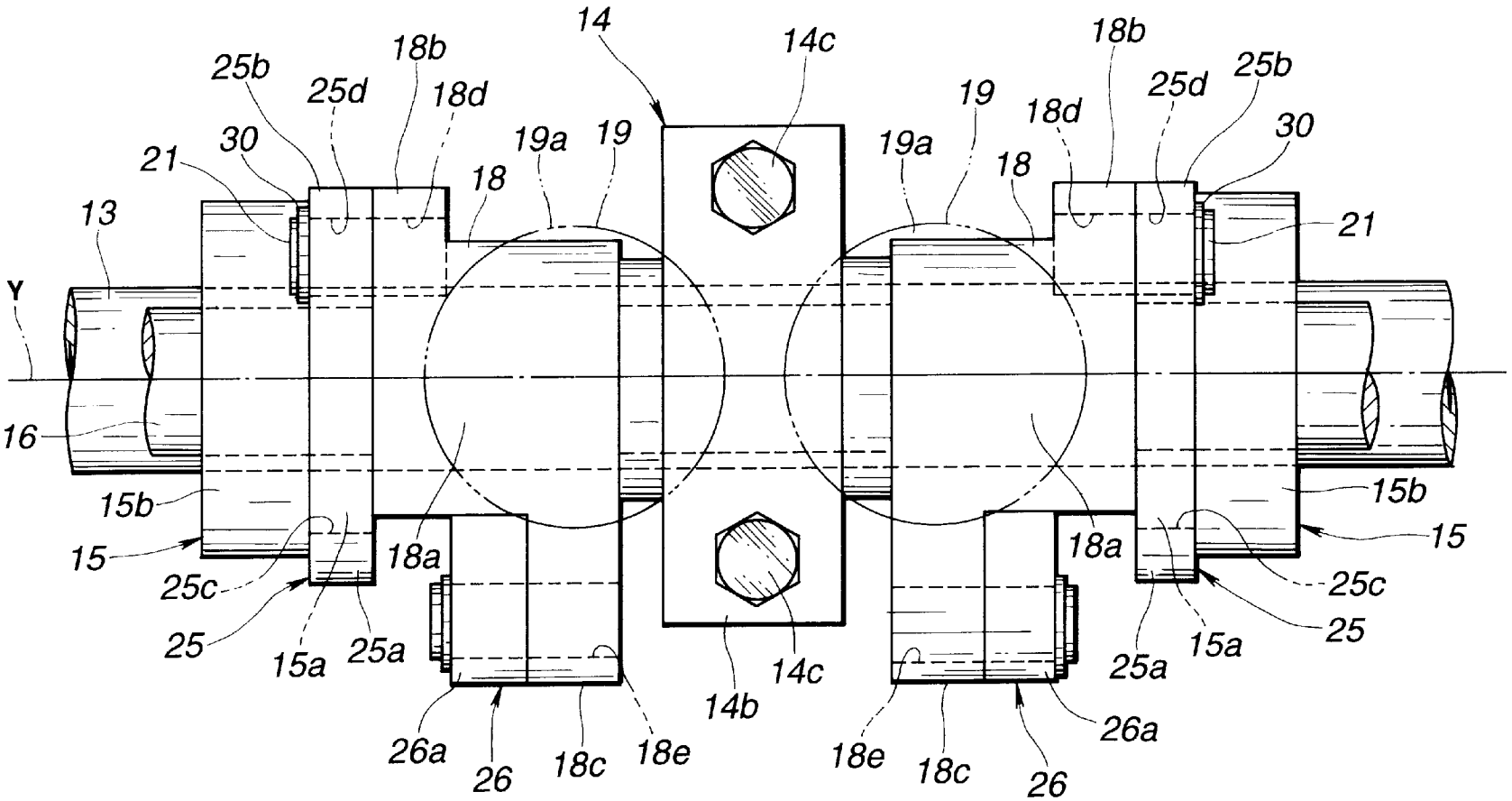
FIG. 3 is a plane view of the upper portion of the cylinder head with the VVA apparatus.

As shown in FIGS. 2 and 3, the crank cams 15, 15 are axially spaced in directions away from the cam bearing 14 to allow layout of valve operating (VO) cams 20, 20 for cooperation with the valve lifters 19, 19. Viewing in FIG. 2, the crank cams 15, 15 on the left and right sides of the cam bearing 14 are not identical in configuration. They are in mirror image relationship with respect to a hypothetical vertical plane bisecting the cam bearing 14. Specifically, the crank cams 15, 15 that are in mirror image relationship have their flange sections 15*b*, 15*b* on the remotest sides of the circular cam sections 15*a*, 15*a* with respect to the cam bearing 14.

Viewing in FIG. 2, the VO cams 20, 20 on the left and right sides are not identical in configuration. They are in mirror image relationship with respect to the hypothetical bisecting vertical plane. The VO cams 20, 20 that are in mirror image relationship are formed with holes 22*a*, 22*a* and have hubs 22, 22 projecting toward each other for abutting contact with the opposite faces of the cam bearing 14. In this embodiment, the VO cams 20, 20 that are in mirror image relationship have the same profile as shown in FIG. 1 although they may have different profiles, if desired.

The driving shaft 13 extends through the holes 22*a*, 22*a* of the VO cams 20, 20 and the holes 15*c*, 15*c* of the crank cams 15, 15. Rotation of the driving shaft 13 about the axis Y will apply no torque or the least torque to the VO cams 20, 20 although it causes the crank cams 15, 15 to move as a unit with the driving shaft 13.

As best seen in FIG. 1, each VO cam 20 includes a cam lobe that extends from the associated hub 22 toward a cam nose portion 23. Each VO cam 20 has a lower peripheral surface 24 in driving cooperation with an upper face 19*a* of the associated valve lifter 19. The lower peripheral surface 24 consists of a cylindrical portion 24*a* of a base circle that extends about the shaft axis Y, and a cam surface portion 24*b* that extends from the cylindrical portion 24*a* to the cam nose portion 23.

The control rod 16 has a control rod axis P2. It has axially spaced eccentric control cams 17, 17, each in the form of a sleeve having an axis P1 and a thickened portion 17*a*.

Viewing in FIG. 2, the control cams 17, 17 are disposed on the left and right sides of the cam bearing 14, respectively, and fixed to the control rod 16 for unitary rotation about the control rod axis P2. Viewing in FIG. 1, the axis P1 of each control cam 17 is offset from the control rod axis P2 by an amount $\alpha$ (alpha). The control cams 17, 17 that are disposed on the left and right sides of the cam bearing 14 support rocker arms 18, 18, respectively, for pivotal motion about the axis P1.

Referring to FIGS. 2 and 3, the rocker arms 18, 18 have sleeves 18*a*, 18*a* that receive the controls cams 17, 17, respectively. The sleeves 18*a*, 18*a* can rotate relative to the control cams 17, 17 about the axis P1.

Viewing in FIGS. 2 and 3, the rocker arms 18, 18 on the left and right sides of the cam bearing 14 are not identical in configuration, but in mirror image relationship with respect to the hypothetical vertical plane bisecting the cam bearing 14. Specifically, the two rocker arms 18, 18 that are in mirror image relationship have first arms 18*b*, 18*b*, and second arms 18*c*, 18*c*. The first arms 18*b*, 18*b* extend in a radial outward direction from and define the remotest ends of the sleeves 18*a*, 18*a* of the left and right rocker arms 18, 18 from the cam bearing 14. The second arms 18*c*, 18*c* extend in another radial outward direction from and define the nearest ends of the sleeves 18*a*, 18*a* of the left and right rocker arms 18, 18 to the cam bearing 14.

The first arms 18*b*, 18*b* are arranged in driving cooperation with the adjacent crank cams 15, 15, respectively, while the second arms 18*c*, 18*c* are arranged in driving cooperation with the adjacent VO cams 20, 20, respectively.

As best seen in FIG. 2, the second arms 18*c*, 18*c* are vertically aligned with the adjacent VO cams 20, 20, respectively.

The first arms 18*b*, 18*b* and the adjacent crank cams 15, 15 are interconnected by crank arms 25, 25, respectively, while the second arms 18*c*, 18*c* and the adjacent VO cams 20, 20 are interconnected by links 26, 26.

As best seen in FIG. 1, each crank arm 25 includes an annular base portion 25*a* and an integral radial extension 25*b*. The annular base portion 25*a* is formed with a cylindrical bore 25*c*, which receives the circular cam section 15*a* of the crank cam 15. Specifically, the annular base portion 25*a* has a cylindrical inner wall that defines the bore 25*c*. This cylindrical inner wall is opposed to the cylindrical outer peripheral surface 15*d* for sliding cooperation therewith to allow movement of the circular cam section 15*a* relative to the annular base portion 25*a*. The radial extension 25*b* includes a hole 25*d*, receiving a pin 21 that is received in a hole 18*d* drilled through the first arm 18*b* of the adjacent rocker arm 18. In this embodiment, at one end portion, the pin 21 is press fitted into the hole 18*d* for providing immobility of the pin 21 relative to the first arm 18*b*. At the other end portion, it is fitted into the hole 25*d* for allowing rotation of the radial extension 25*b* relative to the pin 21. A snap ring 30 engages the pin 21 to prevent removal of the radial extension 25*b* from the pin 21. If desired, a pin 21 may be fixed to the radial extension 25*b*. In this case, the pin 21 is fitted into the hole 18*d* of the first arm 18*b* for allowing rotation of the first arm 18*b* relative to the pin 21. In both of the cases, the pin 21 must be strong enough to keep the holes 18*d* and 25*d* in alignment with each other.

Each link 26 is a curved link with end portions 26*a* and 26*b*. The end portion 26*a* is formed with a hole 26*c* receiving a pin 28 that is press fitted into a hole 18*e* drilled through the second arm 18*c* of the associated rocker arm 18. As shown in FIG. 2, a snap ring 31 engages the pin 28 to prevent removal of the link 26 from the pin 28. The other end portion 26*b* is formed with a hole 26*d* receiving a pin 29 that is press fitted into a hole 23*a* (see FIG. 2) drilled through the associated VO cam 20. A snap ring 32 engages the pin 29 to prevent removal of the link 26 from the pin 29. In this case, the pin 28 is fixed relative to the second arm 18*c* of the rocker arm 18 and the pin 29 is fixed relative to the VO cam 20, while the link 26 is allowed to rotate relative to the pins 28 and 29. If desired, pins 28 and 29 may be fixed relative to the link 26.

In this case, the pin 28 is fitted into the hole 18*e* of the second arm 18*c* for allowing rotation of the second arm 18*c* relative to the pin 28. Further, the other pin 29 is fitted into the hole 23*a* of the VO cam 20 for allowing rotation of the VO cam 20 relative to the pin 29. In both of these cases, the pin 28 must be strong enough to keep the holes 26*c* and 18*e* in alignment with each other, and the pin 29 must be strong enough to keep the holes 26*d* and 23*a* in alignment with each other.

As shown in FIG. 2, an actuator 100, in the form of an electromagnetic actuator, is drivingly coupled with the control rod 16. The actuator 100 is operable in response to a control signal to rotate the control rod 16. An electronic control module (ECM) or a controller 102 is provided. Sensors on the engine send information on engine speed, engine load, vehicle speed, and coolant temperature to the controller 102. The controller 102 generates and applies the control signal to the actuator 100.

As readily understood from the preceding description, the VVA apparatus comprises a cylinder valve 12, a VO cam 20 arranged for pivotal motion about a first predetermined axis Y for operating the cylinder valve 12, and a crank cam 15 arranged for rotation about a second predetermined axis. In the embodiment, the first predetermined axis Y is aligned with the second predetermined axis. The VVA apparatus also comprises a motion transmitting mechanism operatively interconnecting the crank cam 15 and the VO cam 20.

The motion transmitting mechanism includes a rocker arm 18 arranged for pivotal motion about a third predetermined axis P1, a crank arm 25 and a link 26. The rocker arm 18 has a first arm 18b and a second arm 18*c*. The crank arm 25 interconnects the crank cam 15 and the first arm 18*b* for driving the first arm 18*b* in response to the rotation of the crank cam 15. The link 26 interconnects the second arm 18*c* and the VO cam 20 for driving the VO cam 20 for pivotal motion.

The motion transmitting mechanism also includes a control rod 16 arranged for rotation about a fourth predetermined axis P2 and a control cam 17 on the control rod 16. The control cam 17 supports the rocker arm 18 for rotary motion relative thereto about the third predetermined axis P1.

Turning back to FIG. 1, the lower peripheral surface 24 includes the base circle cylindrical surface portion 24*a* that extends through angle θ1 and the cam surface portion 24*b*. The cam surface portion 24*b* may be divided into a ramp portion and a lift portion that extend about the axis Y of the driving shaft 13 through angles θ2, and θ3, respectively.

In this embodiment, the controller 102 determines a desired angular position of the control rod 16 and generates a control signal indicative of the determined desired angular position. The control signal is applied to the actuator 100. In response to the control signal, the actuator 100 rotates the control rod 16 to the desired angular position.

Figure 5B:
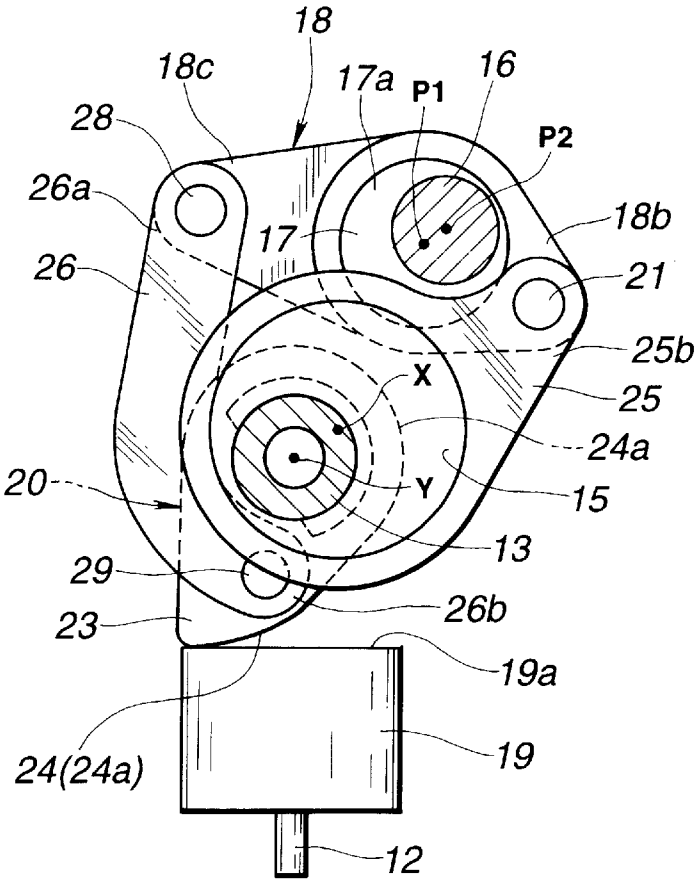
FIG. 5(B) illustrates the position of parts of the VVA apparatus to lift the associated cylinder valve to its fully open position when the motion transmitting mechanism is in the maximum cam lift position.
Figure 5A:
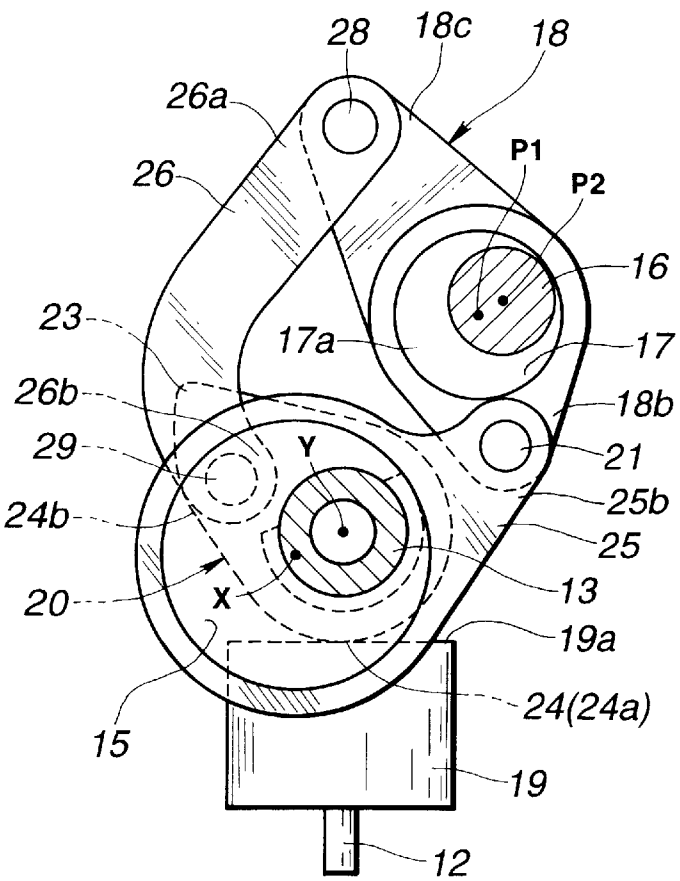
FIG. 5(A) illustrates the position of parts of the VVA apparatus to leave the associated cylinder valve closed when a motion transmitting mechanism is in a maximum cam lift position.
Figure 6B:
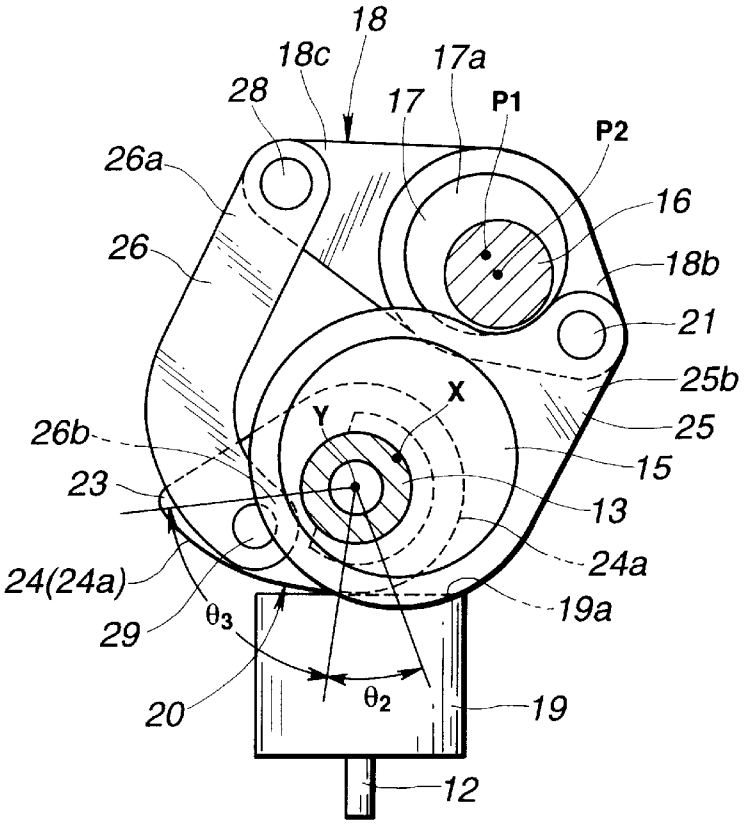
FIG. 6(B) illustrates the position of parts of the VVA apparatus to leave the associated cylinder valve closed when the motion transmitting mechanism is in the minimum cam lift position.
Figure 6A:
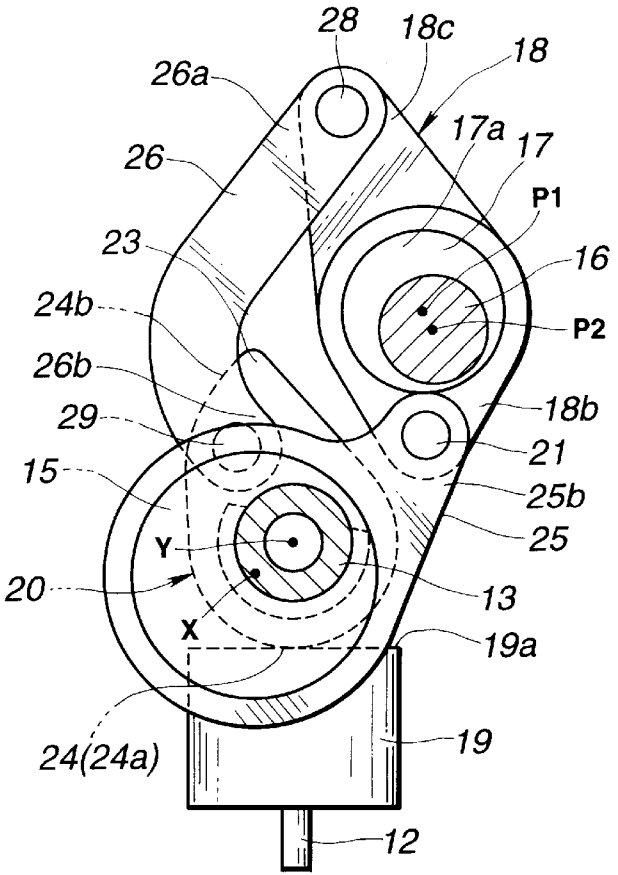
FIG. 6(A) illustrates the position of parts of the VVA apparatus to leave the associated cylinder valve closed when a motion transmitting mechanism is in a minimum cam lift position.

If, for example, engine operation at high speed with heavy load requires the maximum valve lift of each cylinder valve 12, the controller 102 determines, as a desired angular position, an angular position of the control rod 16 as illustrated in FIGS. 5(A) and 5(B). If, engine operation requires that at least some of the cylinder valves 12 be kept closed, the controller 102 determines, as a desired angular position, an angular position as illustrated in FIGS. 6(A) and 6(B). The actuator 100 can rotate the control rod 16 clockwise from the position of FIG. 5(A) to the position of FIG. 6(A) through a predetermined angle and subsequently rotate the control rod 16 counterclockwise to the position of FIG. 5(A) from the position of FIG. 6(A).

During a shift from the position of FIG. 5(A) to the position of FIG. 6(A), the thickened portion 17*a* of each control cam 17 orbits clockwise, viewing in FIG. 5(A), about the axis P2 as the control rod 16 rotates clockwise through the predetermined angle. This orbit motion is allowed by counterclockwise rotation of the crank arm 25 relative to the crank cam 15. As a result of this shift, the direction of eccentricity of the axis P1 of each control cam 17 with respect to the axis P2 of the control rod 16 changes through the predetermined angle. This causes each rocker arm 18 to lift the associated pin 28 from the position of FIG. 5(A) to the position of FIG. 6(A). This causes the link 26 to rotate the VO cam 20 clockwise from the position of FIG. 5(A) to the position of FIG. 6(A).

During a reverse shift from the position of FIG. 6(A) to the position of FIG. 5(A), the thickened portion 17*a* orbits counterclockwise about the axis P2 as the control rod 16 rotates counterclockwise through the predetermined angle.

This orbit motion is allowed by clockwise rotation of the crank arm 25 relative to the crank cam 15. This shift causes each rocker arm 18 to lower the associated pin 28, causing the link 26 to rotate the VO cam 20 counterclockwise from the position of FIG. 6(A) to the position of FIG. 5(A).

Figure 8:
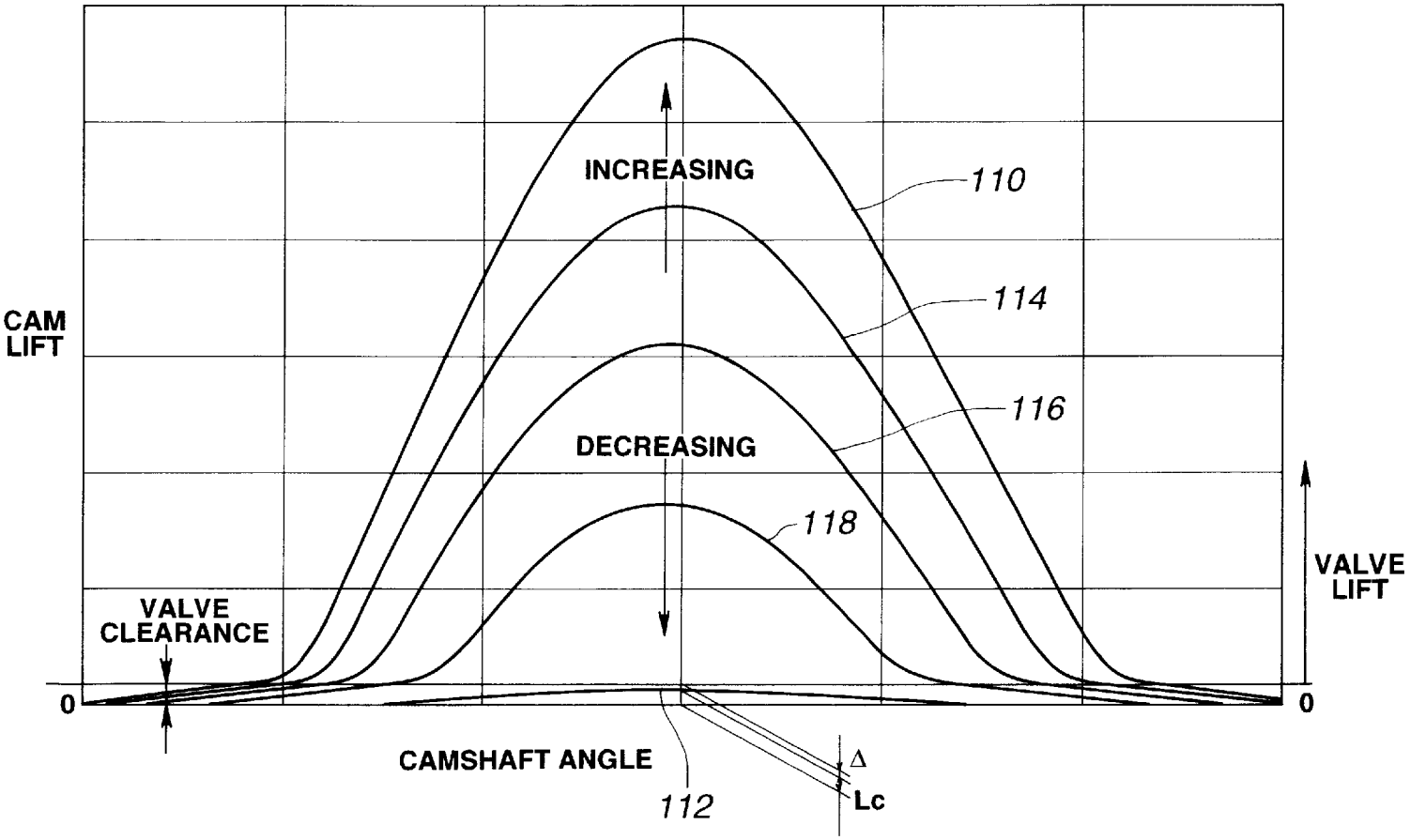
FIG. 8 illustrates cam lift versus camshaft angle characteristic curves provided by the VVA apparatus.

Suppose the pivot axis P1 of the rocker arm 18 takes the position of FIGS. 5(A) and 5(B). In operation of the engine, rotation of the driving shaft 13 through 360 degrees causes the center X to orbit around the axis Y through 360 degrees. First half of each turn of this orbit motion of the center X causes the pin 21 to move from the position of FIG. 5(A) to the position of FIG. 5(B). Second half following this first half causes the pin 21 to move from the position of FIG. 5(B) to the position of FIG. 5(A). Thus, rotation of the driving shaft 13 is converted into reciprocal motion of the pin 21 between the positions of FIGS. 5(A) and 5(B). This reciprocal motion of the pin 21 is translated by the rocker arm 18, pin 28, link 26, and pin 29 into reciprocal pivotal motion of the VO cam 20 between the position of FIG. 5(A) and the position of FIG. 5(B). This reciprocal pivotal motion of the VO cam 20 causes the base-circle cylindrical surface portion 24*a*, the ramp and lift portions of the cam surface portion 24*b* to face the valve lifter 19. The ramp and lift portions of the cam surface portion 24*b* are pressed into contact with the upper face 19*a* of the valve lifter 19, causing the valve lifter 19 to reciprocate between its closed position of FIG. 5(A) and its opened or lifted position of FIG. 5(B). The base-circle cylindrical surface portion 24*a* faces in spaced relation to the upper face 19*a* of the valve lifter 19. A cam lift curve 110 in FIG. 8 illustrates variations in cam lift during this reciprocal pivotal motion of the VO cam 20.

Figure 10:
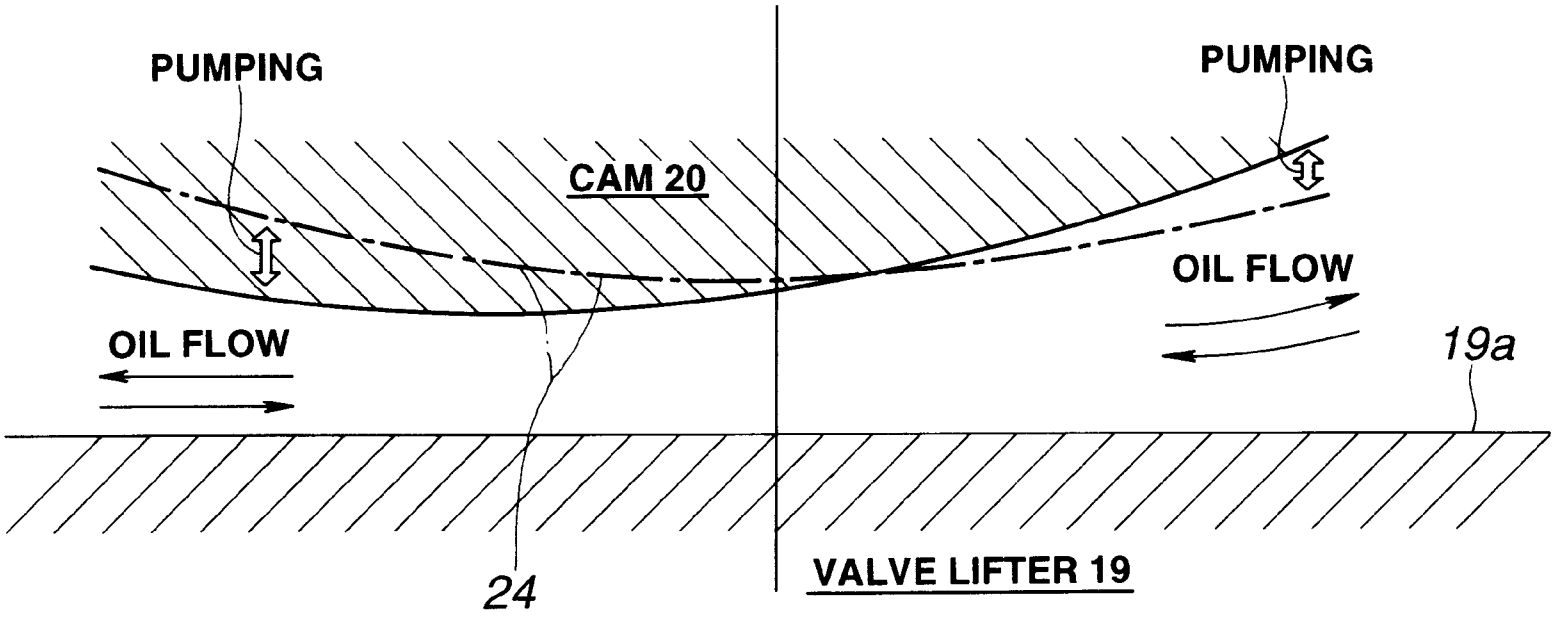
FIG. 10 illustrates a space defined between the VO cam and the valve lifter when the motion transmitting mechanism is in the minimum cam lift position.

Suppose now that the pivot axis P1 of the rocker arm 18 takes the position of FIGS. 6(A) and 6(B). In operation of the engine, rotation of the driving shaft 13 is converted into reciprocal motion of the pin 21 between the position of FIG. 6(A) and the position of FIG. 6(B). This reciprocal motion of the pin 21 is translated by the rocker arm 18, pin 28, link 26, and pin 29 into reciprocal pivotal motion of the VO cam 20 between the position of FIG. 6(A) and the position of FIG. 6(B). This reciprocal pivotal motion of the VO cam 20 causes the base-circle cylindrical portion 24*a* and the ramp portion of the cam surface portion 24*b* to face the upper face 19*a* of the valve lifter 19. During this reciprocal pivotal motion, the ramp portion of the cam surface portion 24*b* will not contact with the upper face 19*a* of the valve lifter 19 as illustrated in FIG. 10, thereby leaving the valve lifter 19 in its closed position.

The ramp portion of the cam surface portion 24*b* faces the upper face 19*a* of the valve lifter 19 during motion of the VO cam 20 in the neighborhood of the position as illustrated in FIG. 6(B). Thus, the cam lift deviates from 0 (zero) and forms a maximum cam lift Lc as illustrated by a cam lift curve 112 in FIG. 8. This maximum cam lift Lc is less than a valve clearance Vcl. The valve clearance Vcl can be expressed in terms of a distance between the VO cam 20 and the upper face 19*a* of the valve lifter 19 when the base-circle cylindrical surface portion 24*a* faces the upper face 19*a*. In FIG. 8, a difference between the valve clearance Vcl and the maximum cam lift Lc is illustrated as Δ (delta).

When the motion transmitting mechanism is in a maximum cam lift position as illustrated in FIGS. 5(A) and 5(B), the pivotal motion of the VO cam 20 is kept within a first angular extension or range. This first angular extension ranges from an angular position of the VO cam 20 in FIG. 5(A) to another angular position thereof in FIG. 5(B). When the motion transmitting mechanism is in a minimum cam lift position as illustrated in FIGS. 6(A) and 6(B), the pivotal motion of the VO cam 20 is kept within a second angular extension or range. This second angular extension ranges from an angular position of the VO cam 20 in FIG. 6(A) to another angular position thereof in FIG. 6(B). Comparing the first and second angular extensions of the VO cam 20 reveals that the range of the second angular extension is narrower than that of the first angular extension and the phase of the former is shifted from the phase of the latter.

In FIG. 8, cam lift curves 114, 116 and 118 illustrate varying cam lifts against varying camshaft angles during reciprocal motion of the VO cam 20 when the axis P1 takes three different positions between the positions of FIGS. 5(A) and 6(A). Each of the curves provides its maximum cam lift. The maximum cam lift of each of the curves is given as the sum of a maximum valve lift and the valve clearance Vcl. The curves 110, 114, 116 and 118 clearly indicate that the maximum cam lift decreases as the axis P1 approaches from the position in FIG. 5(A) to the position in FIG. 6(A). This means that the maximum valve lift decreases accordingly. It will also be seen that valve opening duration decreases as the maximum valve lift decreases.

According to the present embodiment, when the motion transmitting mechanism is in the minimum cam lift position, the VO cam 20 provides the maximum cam lift Lc (see FIG. 8), which is greater than 0 (zero) and less than the valve clearance Vcl. As a result, during the reciprocal motion of the VO cam 20, the lower peripheral surface 24 moves toward and away from the upper face 19*a* of the valve lifter 19, compressing and expanding a space between them. In this manner, a cycle of compression and expansion phases of the space is repeated although the VO cam 20 remains out of contact with the valve lifter 19. Thus, the intake valve 12 remains closed when the motion transmitting mechanism is in the minimum cam lift position.

Figure 7:
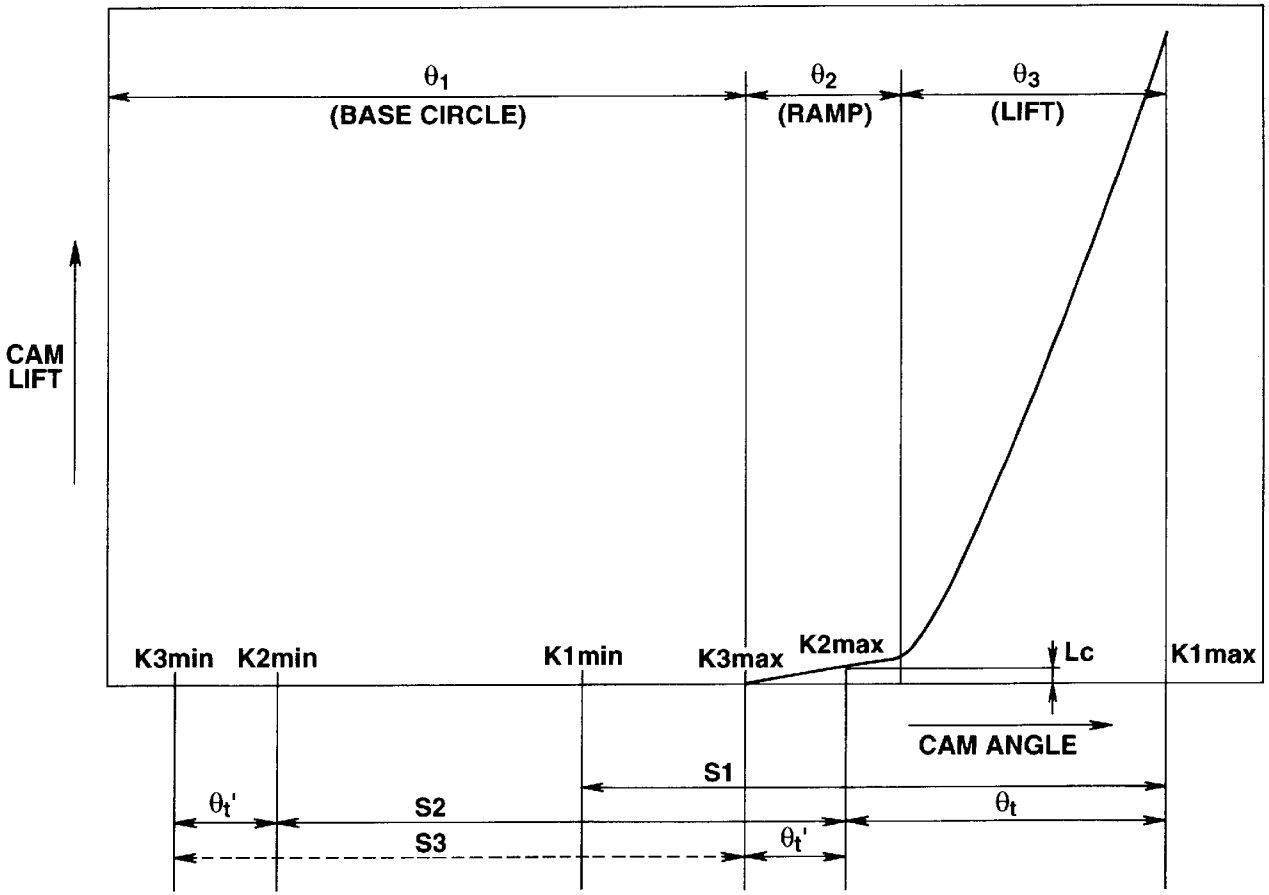
FIG. 7 illustrates a cam lift versus cam angle characteristic curve of a VO cam.
Figure 9B:
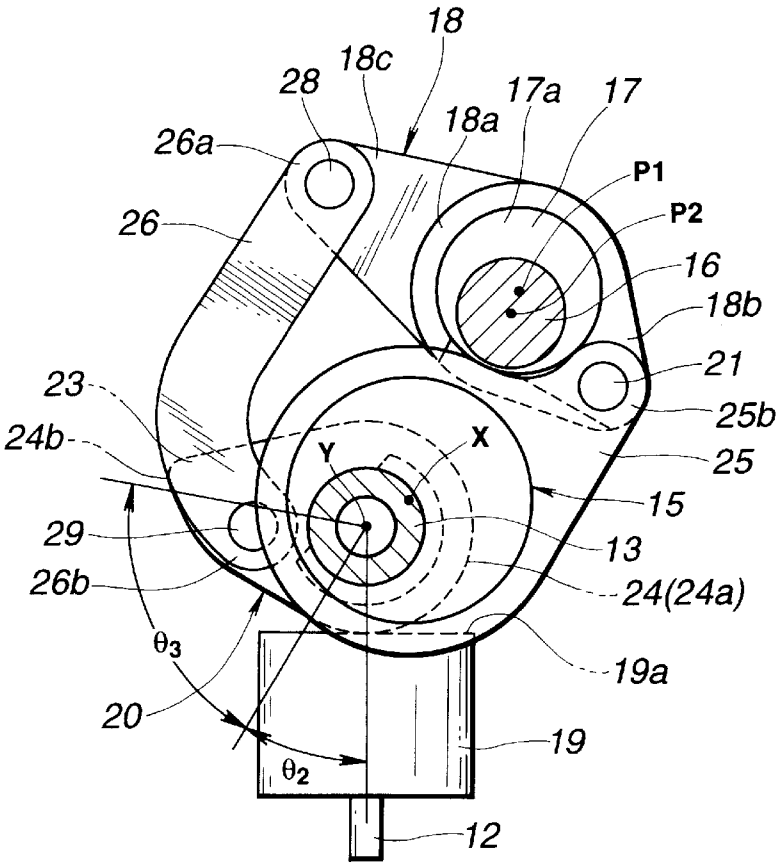
FIG. 9(B) illustrates the position of parts of the VVA apparatus to leave the associated cylinder valve closed when the motion transmitting mechanism is in the zero cam lift position.
Figure 9A:
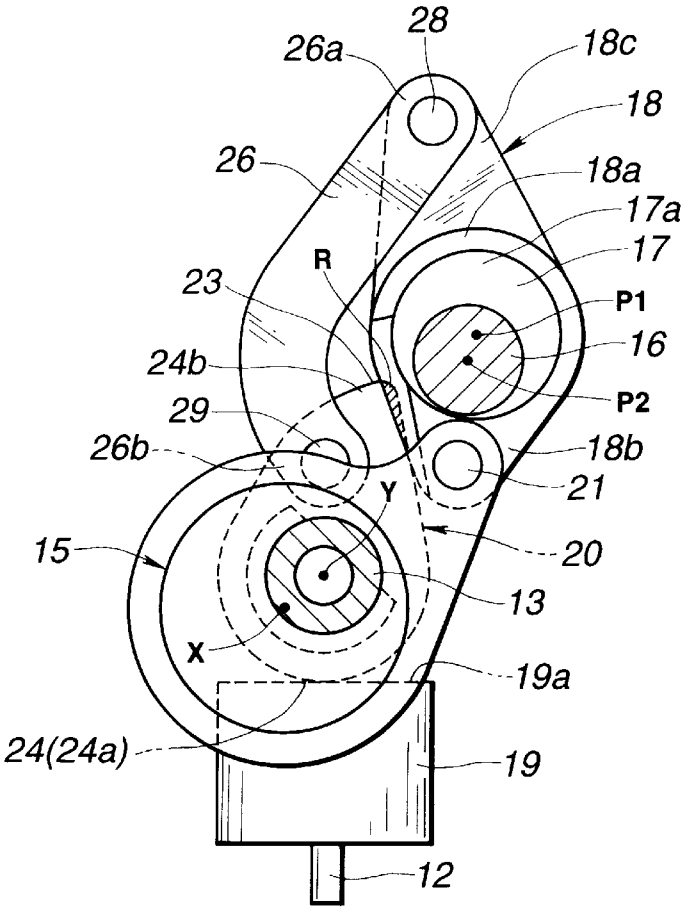
FIG. 9(A) illustrates the position of parts of the VVA apparatus to leave the associated cylinder valve closed when the motion transmitting mechanism is in a zero cam lift position.

Referring to FIG. 7, a cam lift versus cam angle characteristic curve of the VO cam 20 is explained. This curve shows varying cam lifts provided by the VO cam 20 against varying degrees through which the VO cam 20 rotates about the axis Y. In FIG. 7, a double-headed dotted arrow S3 indicates the extension of a portion that faces the upper face 19*a* of the valve lifter 19 during pivotal motion of the VO cam 20 when the motion transmitting mechanism is in a zero lift position. This portion S3 ranges from an angular position K3max, as illustrated in FIG. 9(B), on a boarder between the base circle portion and the ramp portion to an angular position K3min, as illustrated in FIG. 9(A), within the base circle portion. In this case, the cam lift remains 0 (zero) during pivotal motion of the VO cam 20 because the portion S3 extends within the base circle portion.

In FIG. 7, a fully drawn double-headed arrow S2 indicates the extension of a portion that faces the upper face 19*a* of the valve lifter 19 during pivotal motion of the VO cam 20 when the motion transmitting mechanism is in the minimum lift position. This portion S2 ranges from an angular position K2max, as illustrated in FIG. 6(B), within the ramp portion to an angular position K2min, as illustrated in FIG. 6(A), within the base circle portion. In this case, at the angular position K2max, the VO cam 20 provides the maximum cam lift Lc that is greater than 0 (zero) and less than the valve clearance Vcl (see the cam lift diagram 112 in FIG. 8).

In FIG. 7, a fully drawn double-headed arrow S1 indicates the extension of a portion that faces the upper face 19*a* of the valve lifter 19 during pivotal motion of the VO cam 20 when the motion transmitting mechanism is in the maximum lift position. This portion S1 ranges from an angular position K1max, as illustrated in FIG. 5(B), within the lift portion to an angular position K1min, as illustrated in FIG. 5(A), within the base circle portion. In this case, at the angular position K1max, the VO cam 20 provides the maximum cam lift (see the cam lift diagram 110 in FIG. 8).

Comparing the portion S3 with the portion S2 reveals that the portion S3 is spaced further from the angular position K1max than the portion S2 is by an amount $\theta_t'$ in terms of cam angle in degrees through which the VO cam 20 rotates about the axis Y. This amount is considerably great because the cam lift varies against the cam angle at a very small rate over the ramp portion. Thus, during a shift from the maximum to the zero cam lift positions, the VO cam 20 has to undergo an additional rotation about the axis Y by the amount $\theta_t'$ to bring the portion 53 into facing relation with the upper face 19*a* of the valve lifter 19. Such additional rotation is no longer needed during a shift from the maximum to the minimum lift positions where the VO cam 20 rotates to bring the portion S2 into facing relation with the upper face 19*a* of the valve lifter 19.

FIG. 9(A) shows the position of parts of the VVA apparatus when the motion transmitting mechanism is in the zero cam lift position and the VO cam 20 takes the angular position K3min (see FIG. 7). In this position, the VO cam 20, link 26 and rocker arm 18 stand generally vertically, thereby occupying a large space in vertical dimension to install above the cylinder head. However, it is difficult to find such a space above the cylinder head within an engine compartment. Further, the rocker arm 18 needs a recess or cutout to avoid interference between the rocker arm 18 and the cam nose 23. In FIG. 9(A), an area where the interference otherwise would occur is shadowed. Machining such recess or cutout causes an increase in number of process steps in manufacturing the VVA apparatuses.

According to the preferred embodiment, when the motion transmitting mechanism is in the minimum cam lift position, the VO cam 20 provides the maximum cam lift Lc that is greater than 0 (zero) and less than the valve clearance Vcl at the position as illustrated in FIG. 6(B). In this minimum cam lift position, the portion S2 covers part of the rams portion as illustrated in FIG. 7. Thus, the degree through which the VO cam 20 rotates for a shift from the portion S1 to the portion S2 has been reduced by $\theta_t'$ to $\theta_t$ as compared to a shift from the portion Si to the portion S3.

FIG. 6(A) shows the position of the VVA apparatus when the motion transmitting mechanism is in the minimum cam lift position and the VO cam 20 takes an angular position K2min as illustrated in FIG. 7. Comparing FIG. 6(A) with FIG. 9(A) reveals that the space occupied by VO cam 20, link 26 and rocker arm 18 has become reduced in vertical dimension considerably according to the present embodiment. Further, the space in which the parts of the VVA apparatus will move in operation has become reduced in volume according to the present embodiment. Thus, the installation difficulty of the VVA apparatus has been alleviated. Further, the VVA apparatus according to the present embodiment is free from the interference between the cam nose 23 and the rocker arm 18.

It is generally known that sufficient supply of lubricant oil to the interface between the VO cam 20 and the valve lifter 19 is not expected during pivotal motion of the VO cam 20 when the motion transmitting mechanism is in the zero cam lift position. This is because a space between the lower peripheral surface 24 of the VO cam 20 and the upper face 19*a* of the valve lifter 19 is unaltered in volume during pivotal motion of the VO cam 20.

FIG. 10 illustrates the space defined between the lower peripheral surface 24 of the VO cam 20 and the upper face 19*a* of the valve lifter 19 when the motion transmitting mechanism is in the minimum cam lift position. In this minimum cam lift position as illustrated in FIGS. 6(A) and 6(B), the lower peripheral surface 24 is out of contact with the upper face 19*a* of the valve lifter 19, thereby leaving the associated valve 12 closed. During the reciprocal motion of the VO cam 20 between the positions of FIGS. 6(A) and 6(B), the lower peripheral surface 24 of the VO cam 20 comes closer to the upper face 19*a* of the valve lifter 19 periodically. Thus, the space is subjected to compression and expansion in each cycle, thereby introducing lubricant oil onto the lower peripheral surface 24 and the upper face 19*a*. It is appreciated that the VVA apparatus exhibits improved lubrication performance during operation mode to keep the associated cylinder valve 12 closed.

According to the present embodiment, the camshaft 13 supports the crank cam 15 and the VO cam 20 in a coaxial manner. This arrangement has proved to be effective in reducing the installation space in lateral dimension, with respect to the longitudinal line of the engine.

The VVA apparatus according to the present embodiment no longer requires a separate pivot structure for supporting the VO cam 20. This makes it unnecessary to prepare parts of the separate pivot structure, causing a reduction in number of parts of the VVA apparatus. It is appreciated that the elimination of the separate pivot structure has reduced the deviation the pivot axis of the VO cam 20 to zero. This has caused the VVA apparatus to enhance its control accuracy of the valve timing.

According to the VVA apparatus of the present embodiment, the crank cam 15, which is a circular cam, is fitted in the crank arm 25 for rotation relative thereto. This arrangement gives even distribution of stress over the entire circular outer surface of the, crank cam 15, thereby suppressing occurrence of wear of the crank cam 15 and the crank arm 25.

Since the stress, which the crank cam 15 has to bear per unit area, has reduced in amount, it is now possible to use materials of wider variations in forming the crank cam.

Figure 11A:
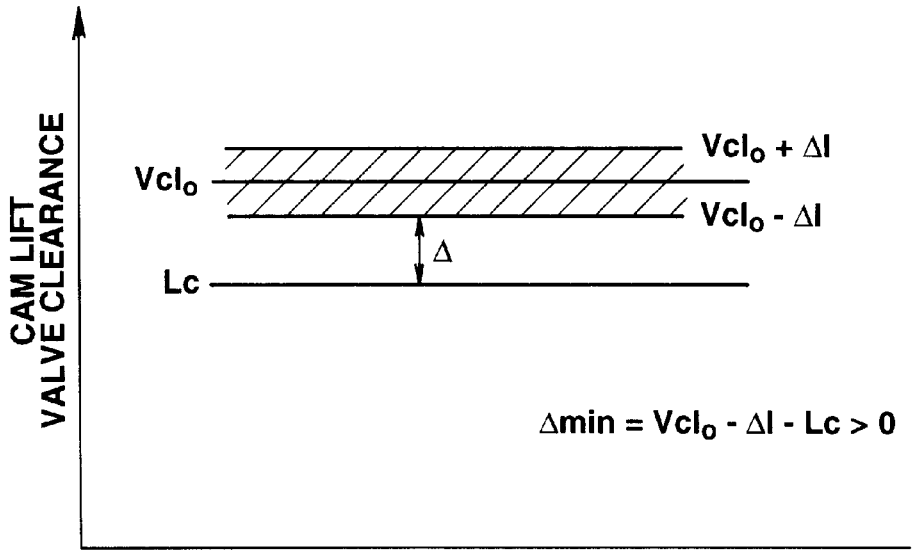
FIGS. 11(A) and 11(B) illustrate windows of the valve clearance where variations are not negligible.

FIGS. 11(A) and 12(B) illustrate how to determine the valve clearance Vcl.

The shadowed area in FIG. 11(A) illustrates the valve clearance Vcl, which may be expressed as follows:

$$Vcl=Vcl_0\pm\Delta l$$

where: $Vcl_0$ is a specified value; and Δl is a tolerance. Then, the minimum Δmin of the clearance Δ (see FIG. 8) is given by the following equation and Δmin must be greater than zero (Δmin>0):

$$\Delta min=Vcl_0-\Delta l-Lc$$

where: Lc is the maximum cam lift in the minimum cam lift position.

Figure 11B:
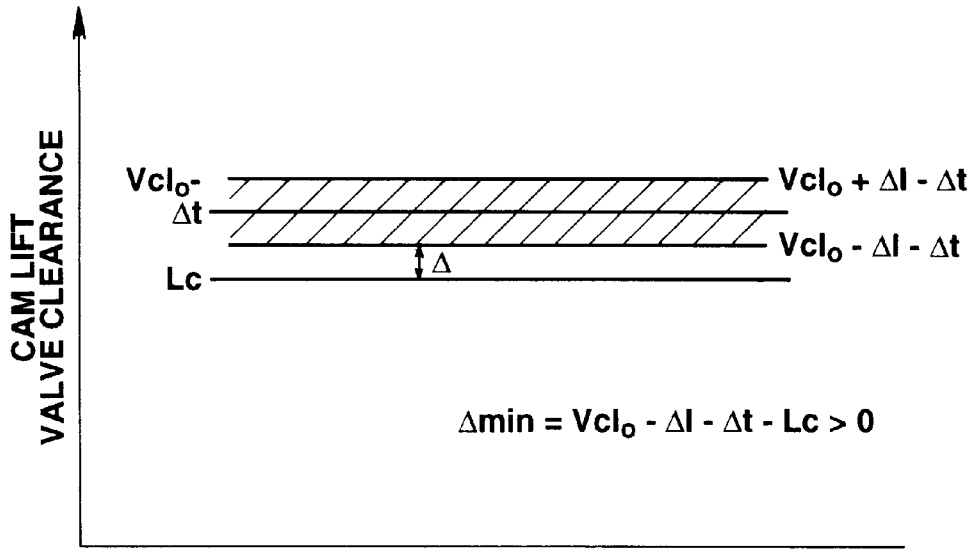

The shadowed area in FIG. 11(B) illustrates the valve clearance Vcl if variations in valve clearance due to the other causes such as thermal expansion are not negligible. The valve clearance Vcl may be expressed as:

$$Vcl=Vcl_0\pm\Delta l-\Delta t$$

where: at is a reduction due to the other causes including thermal expansion.

Then, the minimum Δmin of the clearance Δ (see FIG. 8) is given by the following equation and Δmin must be greater than zero (Δmin>0):

$$\Delta min=Vcl_0-\Delta l-\Delta t-Lc.$$

In both of the above-mentioned cases, the valve clearance Vcl is subject to variations and thus has a window having an upper limit and a lower limit. In determining the maximum cam lift Lc, the lower limit is regarded as the valve clearance Vcl.

Thus, where the valve clearance Vcl is subject to the variations, the maximum cam lift Lc can be expressed as:

$$Vcl_0-\Delta l>Lc>0 \text{ or } Vcl_0-\Delta l\Delta t>Lc>0.$$

It will now be appreciated that the maximum cam lift Lc must be greater than 0 (zero) and less than the lower limit of the valve clearance Vcl if the variations are not negligible. This relation is required for keeping the associated valve closed when the motion transmitting mechanism is in the minimum cam lift position.

In the preceding embodiment, the present invention has been explained in association with intake valves. The present invention is not limited to this implementation. The present invention may be applied to cylinder bank having exhaust valves.

In the preceding embodiment, the present invention has been explained in association with the VVA apparatus illustrated in FIGS. 1 to 4. The present invention is not limited to the illustrated VVA apparatus. The present invention may be applied to VVA apparatuses disclosed in pending U.S. patent. application Ser. No. 09/130,490 filed on Aug. 7, 1998, which has been commonly assigned herewith and incorporated by reference in its entirety. This United State Patent Application corresponds to German Patent Application No. 198 35 921.7 filed on Aug. 7, 1998.

The content of disclosure of Japanese Patent Application No. 9-305120, filed Nov. 7, 1997 is hereby incorporated by reference in its entirety.

What is claimed is:

1. A variable valve actuation (VVA) apparatus in an internal combustion engine having cylinder valves, comprising:

a cylinder valve having a valve closed position;

valve lifter a valve operating (VO) cam arranged for pivotal motion about a first predetermined axis for operating said cylinder valve via said valve lifter;

a crank cam arranged for rotation about a second predetermined axis;

a motion transmitting mechanism operatively interconnecting said crank cam and said VO cam, said motion transmitting mechanism having a maximum cam lift position wherein said pivotal motion of VO cam is restrained within a first extension and a minimum cam lift position wherein said pivotal motion is restrained within a second extension;

said VO cam having a base circle portion, said VO cam and said valve lifter defining therebetween a valve clearance when said base circle portion assumes a predetermined relation relative to said cylinder valve;

wherein, when said motion transmitting mechanism is in said minimum lift position, the VO cam provides variable cam lift values during said pivotal motion thereof, said variable cam lift values having the maximum cam lift that is greater than zero and less than said valve clearance.

2. The VVA apparatus as claimed in claim 1, wherein said valve clearance results from subtracting a tolerance from a specified value.

3. The VVA apparatus as claimed in claim 1, wherein said valve clearance results from subtracting an empirically experimentally determined variation after subtracting a tolerance from a specified value.

4. The VVA apparatus as claimed in claim 1, further comprising a controller including a rule that said motion transmitting mechanism be prohibited from taking said minimum lift position under predetermined conditions of the engine.

5. The VVA apparatus as claimed in claim 1, wherein said motion transmitting mechanism includes a rocker arm arranged for pivotal motion about a third predetermined axis, said rocker arm having a first arm driven by said crank cam and a second arm driving said VO cam.

6. The VVA apparatus as claimed in claim 5, wherein said motion transmitting mechanism includes a control rod arranged for rotation about a fourth predetermined axis, and a control cam on said control rod supporting said rocker arm for rotary motion relative thereto about said third predetermined axis.

7. The VVA apparatus as claimed in claim 6, wherein said control cam is a circular eccentric cam having a center thereof on said third predetermined axis and attached to said control rod with said predetermined axis arranged in parallel to and deviated from said fourth predetermined axis.

8. The VVA apparatus as claimed in claim 7, wherein said motion transmitting mechanism includes a crank arm interconnecting said crank cam and said first arm of said rocker arm, and a link interconnecting said second arm of said rocker arm and said VO cam.

9. The VVA apparatus as claimed in claim 1, wherein said first predetermined axis is aligned with said second predetermined axis.

10. The VVA apparatus as claimed in claim 9, wherein said crank cam is an eccentric circular cam having a center thereof orbiting about said second predetermined axis as said crank cam rotates about said second predetermined axis.

11. The VVA apparatus as claimed in claim 10, further comprising a camshaft arranged for rotation about said second predetermined axis, said camshaft supporting said crank cam and said VO cam.

12. The VVA apparatus as claimed in claim 8, wherein said first predetermined axis is aligned with said second predetermined axis.

13. The VVA apparatus as claimed in claim 12, wherein said crank cam is an eccentric circular cam having a center thereof orbiting about said second predetermined axis as said crank cam rotates about said second predetermined axis.

14. The VVA apparatus as claimed in claim 13, further comprising a camshaft arranged for rotation about said second predetermined axis, said camshaft supporting said crank cam and said VO cam.

15. The VVA apparatus as claimed in claim 14, further comprising:

an actuator connected to said control rod, said actuator being operative to rotate said control rod about said fourth predetermined axis in response to a control signal to shift said motion transmitting mechanism to said minimum lift position; and a controller generating said control signal, said controller being operative to prohibit generating said control signal when the engine operates under predetermined conditions.

16. The VVT apparatus as claimed in claim 1, wherein, when said motion transmitting mechanism is in said minimum lift position, said VO cam repeats cycle of compression and expansion of space between said VO cam and said valve lifter.

* * * * *